United States Patent [19]

Buchtel

[11] 4,421,964

[45] Dec. 20, 1983

[54] REMOTE SWITCH ACTUATION

[75] Inventor: Dean H. Buchtel, Canton, Ohio

[73] Assignee: The Hoover Company, North Canton, Ohio

[21] Appl. No.: 364,780

[22] Filed: Apr. 2, 1982

[51] Int. Cl.[3] ..... H01H 9/06

[52] U.S. Cl. ..... 200/157; 200/331

[58] Field of Search ..... 200/331, 157

[56] References Cited

U.S. PATENT DOCUMENTS

| | | | |
|---|---|---|---|
| 1,546,474 | 7/1925 | Connell | 200/157 |
| 1,667,158 | 4/1928 | Ives | 200/157 |
| 3,366,764 | 1/1968 | Korshak et al. | 200/331 X |
| 4,121,063 | 10/1978 | Aimi | 200/331 X |
| 4,280,026 | 7/1981 | Alessio | 200/331 X |
| 4,295,026 | 10/1981 | Williams et al. | 200/331 |
| 4,333,689 | 6/1982 | Fujino | 200/331 X |

FOREIGN PATENT DOCUMENTS

| | | | |
|---|---|---|---|
| 582396 | 9/1959 | Canada | 200/331 |
| 775247 | 5/1957 | United Kingdom | 200/331 |

OTHER PUBLICATIONS

Model JK-153A—Hand Held Cleaner by Hiroaka & Co. Ltd., offered for sale in U.S. on 9/15/81.

*Primary Examiner*—John W. Shepperd
*Assistant Examiner*—Renee S. Kidorf
*Attorney, Agent, or Firm*—Gerald H. Kreske; Richardson B. Farley

[57] ABSTRACT

There is provided an actuating means, remote from the switch it actuates. A thin, flexible, lamella like link extends between the switch and actuating means, with the link moving in an enclosing channel for guidance.

6 Claims, 6 Drawing Figures

REMOTE SWITCH ACTUATION

BACKGROUND OF THE INVENTION

1. Field of the Invention

This invention relates to remotely actuated switches and, more specifically, relates to a flexible link connection between a switch and its actuating means.

2. Summary of the Prior Art

Heretofore it is known to provide a solid linkage between a switch actuating means and a switch. The closest known are employs a solid, thin, metallic, rigid rod between an actuating button and a switch. However, such an arrangement does not provide flexibility to the relative location of the switch and button since the rod is not readily bendable. Further, such a rod is relatively expensive in view of the cost of a plastic, lamella like link which can be used with desired modifications to its surrounding structure.

Accordingly, it is an object of this invention to provide a flexible linkage arrangement between a switch and its actuating means.

It is an additional object of this invention to provide a plastic, lamella like linkage between a switch and its actuating button.

It is a further object of the invention to provide a channeled arrangement for guidance of the flexible linkage.

It is a still further object of the invention to provide for remote switch actuation by the use of a flexible link extending through the handle of an appliance.

Other and further objects of the invention will become apparent as the description of it proceeds.

SUMMARY OF THE INVENTION

The invention includes the disposition of a switch actuating means such as a button remote from a switch. A flexible, lamella like link made of molded plastic or the like is disposed between the switch actuating means and switch, with the link being guided in its movement by a ribbed channel.

Because of the flexibility of the link, the switch actuating means can be mounted in the handle of, for example, a floor care appliance, while the switch can be mounted in its main body, thus, eliminating obtrusive wiring in the handle and also maintain a slimmer more comfortable handle.

DESCRIPTION OF THE DRAWINGS

Reference may now be had to the accompanying drawings for a better understanding of the invention, both as to its organization and function, with the illustration being only exemplary, and in which.

DESCRIPTION OF THE PREFERRED EMBODIMENT

Figures 1, 2, 3, 4, 5, 6:
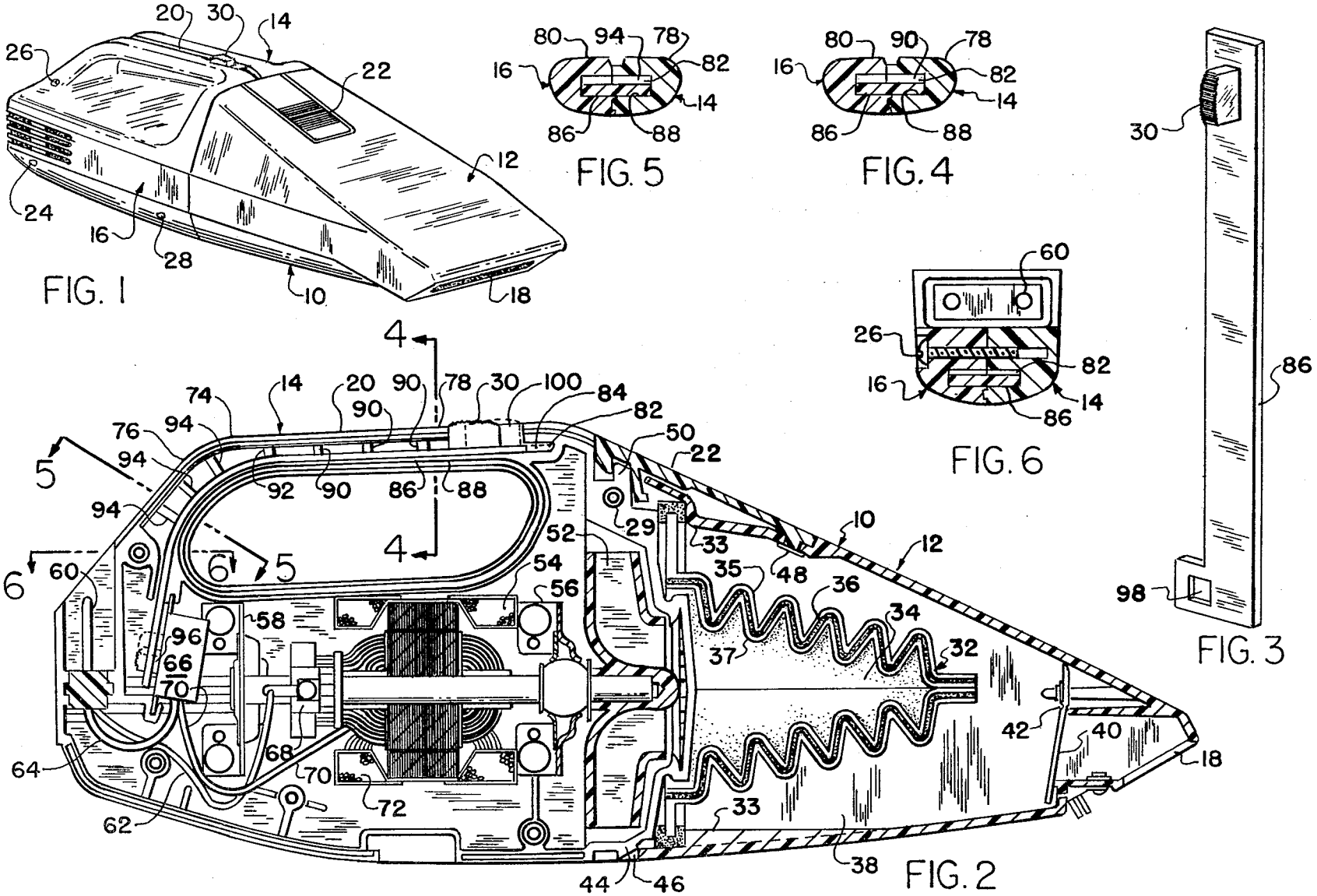
FIG. 1 is a perspective view of a hand held cleaner incorporating my invention.
FIG. 2 is a cross sectional view of the cleaner with the cover half of the rear shell removed.
FIG. 3 is a perspective view of the flexible link of this invention.
FIG. 4 is a cross sectional view of the link and channel taken on line 4—4 of FIG. 2.
FIG. 5 is a similar showing but taken on line 5—5.
FIG. 6 is a similar showing but taken on line 6—6.

There is shown in FIG. 1, a hand held cleaner 10 including a plastic snout section 12 and a pair of plastic rear housing halfs 14, 16. The snout section 12 includes a suction aperture 18 while the housing halfs 14, 16 include a handle 20 as integral therewith. A latch 22 engages the snout section to the housing halfs 14, 16 and these halfs are connected together by screws 24, 26, 28 and 29. A button 30, for actuation of the hand held cleaner 10, moves along the top of the handle 20 for easy access to it by the operator of he hand held cleaner 10.

Turning to the remaining figures in the drawings, snout section 12 houses a filter means 32, lodged against a rib arrangement 33 in snout section 12, having generally zig-zag triangular sidewalls 34 (only one shown) on which is mounted between outer and inner ledges 35, 37, in zig-zag fashion, a filter medium 36 of paper or the like so that the filter means 32, overall, has a prismatic shape.

With the filter means 32 disposed as shown, a cavity 38 in snout section 12 presents itself forwardly of the filter means 32 within which entrained dirt and dust is received. In order to prevent a backward flow of the dirt or dust, as is conventional, a trap door 40 having a living hinge 42 is disposed adjacent the suction aperture 18.

Snout section 12 is connected to rear housing halfs 14, 16 by means of a latch arrangement. This latch arrangement includes a tab 44 on each of the housing halfs 14, 16 (only one shown) which are aligned and abutting and mate with a tab aperture 46 on the bottom of snout section 12. On the top of snout section 12 is the aforementioned latch 22 having a heat weld 48 for retention by the snout section 12. This latch is made of resilient material and is, therefore, capable of camming over and locking behind latching ledge 50 (formed partly on each of the rear housing half 14, 16). Interengagement of the tab 44 and tab aperture 46 and interengagement of the latch 22 and latching ledge 50 holds the hand held cleaner 10 together securely.

Disposed within the rear housing halfs 14, 16 is a fan 52 driven by a motor 54. Motor 54 is attached to rear housing half 14 by brackets 56, 58 having screwed attachment therewith as is conventional in the art. A pair of male prongs 60 (only one shown) are disposed in the rear housing halfs 14, 16 for the reception of a female receptacle (not shown) leading to the supply line (not shown). A pair of leads 62, 64 extend from these prongs and are connected to a slide switch 66 and a carbon brush connector for commutator 68 of the motor 54. Another lead 70 extends from the slide switch 66 (which is entirely conventional) to a field 72 of motor 54.

The handle 20 is formed with a relatively long extension 74 which is straight and a downturned portion 76 having a fairly sharp curve to smoothly conform with the operator's grasp and terminating in the rear of the hand held cleaner 10. The handle 20 is formed by generally mating halfs 78, 80, i.e., upper portions of rear housing halfs 14, 16 to form a hollow cross section 82 extending along the straight extension 74 and the downturned curved portion 76 to thereby form a slot 84 for guiding movement of a long, flexible link 86. This link, preferably, is molded from plastic and is in the form of a lamella like structure that is very flexible to bending through its narrow depth but of sufficient columnar strength, because of its width, to act as a force transmitting member.

In order to guide this member, link 86 moves along a flat 88 formed in the bottom of the slot 84, and, between this flat and the bottom terminations of a series of ribs 90, 90, 90, 92, 94, 94 and 94 formed in the mating handle halfs 78, 80, half of each rib in each. The ribs and flat closely conform to the bottom and top sides of the flexible link 86 to prevent kinking (localized bending), through its narrow depth while permitting the passage of a thrust force along the link's linear extent. At the same time, link 86 is flexible enough for guided bending so that as the slot 84 curves, the link 86, correspondingly, bends, still without kinking to pass a thrust force to a switch button 96 of slide switch 66. The ribs 90, 90, 90, 92, 94, 94 and 94 are utilized rather than a solid mass in the handle halfs 78, 80 for forming an upper flat for the flexible link 86 so as to conserve material and reduce molding shrinkage problems.

The flexible link 86 includes an aperture 98 which receives the switch button 96, with this aperture offset relative to the linear extent of flexible link 86 to insure contact with switch button 96 mounted with switch 66 in the rear housing half 14. The actuating button 30 is also made integral, advantageously, with the flexible link 86 and moves in a slot 100 formed in the housing halfs, the slot limiting linear movement of the actuating button 30 and the flexible link 86.

The operation of the invention should be clear. Actuation of integral actuating button 30 by an operator grasping handle 20 causes movement of it in a linear direction, between its two shown positions, imposing an axial force on thrust link 86 and moving it linearly. Through aperture 98, the switch button 96 moves linearly, between its two shown positions, to activate or deactivate the motor 54 so that the hand held cleaner 10 is turned on or off.

It should, therefore, be obvious that the objects of the invention have been complied with by the specific embodiment described. It should also be obvious that many deviations and variations of the disclosed invention could be made by one skilled in the art which would still come within the scope and purview of the description.

What is claimed is:

1. A hand held appliance including;

(a) a handle having a straight section and a relatively steeply curved section, (b) a switch actuating button disposed adjacent to said handle, (c) a guideway formed by said handle and extending longitudinally therealong, (d) a switch for said hand held appliance disposed adjacent said guideway and remote from said switch actuating button, (e) a flexible lamella-like link, extending in said guideway, attached to said switch and said switch actuating button adjacent its terminations, (f) whereby said flexible link moves, upon movement of said switch actuating button, to actuate said switch.

2. The hand held appliance of claim 1 wherein;

(a) said guideway is formed by a slot and said slot extends through said relatively steeply curved section of said handle so as to be relatively steeply curved, and (b) said flexible link moves reciprocally through said slot in said relatively steeply curved section to provide thrust for actuation of said switch.

3. The hand held appliance of claim 1 wherein;

(a) said flexible link is guided by ribs formed by said housing in said guideway.

4. The hand held appliance of claim 1 wherein;

(a) said guideway is formed by a slot, and said slot has a bottom, substantially continuous flat face against which the flexible link abuts.

5. The hand held appliance of claim 1 wherein;

(a) said flexible link has an aperture for engagement with an actuating button of said switch.

6. The hand held appliance of claim 1 wherein;

(a) said flexible link is molded plastic, and (b) said switch actuating button is formed with said flexible link.

* * * * *